US006569031B2

(12) United States Patent
Toyota

(10) Patent No.: US 6,569,031 B2
(45) Date of Patent: May 27, 2003

(54) IRON CLUB HEAD

(75) Inventor: Masayuki Toyota, Kagawa-ken (JP)

(73) Assignee: Kasco Corporation, Ogawa-gun (JP)

( * ) Notice: Subject to any disclaimer, the term of this patent is extended or adjusted under 35 U.S.C. 154(b) by 41 days.

(21) Appl. No.: 09/754,763

(22) Filed: Jan. 4, 2001

(65) Prior Publication Data

US 2002/0006834 A1 Jan. 17, 2002

(30) Foreign Application Priority Data

Jul. 14, 2000 (JP) ..... 2000-019487

(51) Int. Cl.[7] ..... A63B 53/04

(52) U.S. Cl. ..... 473/290; 473/473; 473/338; 473/349; 473/291; 473/309

(58) Field of Search ..... 473/378, 255, 473/305, 290; D21/749, 747; 29/525

(56) References Cited

U.S. PATENT DOCUMENTS 3,655,188 A * 4/1972 Solheim ..... 473/290
4,632,400 A * 12/1986 Boone ..... 473/305
4,854,581 A * 8/1989 Long ..... 473/290
5,044,637 A * 9/1991 Wilson ..... 473/255
5,312,105 A * 5/1994 Cleveland ..... 473/350
5,320,347 A * 6/1994 Parente et al. ..... 473/305
D350,800 S * 9/1994 Ota ..... D21/747
5,401,021 A * 3/1995 Allen ..... 473/291
5,429,355 A * 7/1995 Schmidt et al. ..... 29/525
D419,628 S * 1/2000 Williams, Jr. ..... D21/749

* cited by examiner

*Primary Examiner*—Paul T. Sewell
*Assistant Examiner*—Thanh Duong
(74) *Attorney, Agent, or Firm*—Frishauf, Holtz, Goodman & Chick, P.C.

(57) ABSTRACT

A sole of a head is inclined upwardly toward a side of a hosel section. A proximal section of the hosel section, which is continuous to a top, is set to be low. Accordingly, the weight of the head on the side of the hosel section is reduced, while the weight is distributed to circumferential portions of the head. Thus, the moment of inertia is set to be increased, and the sweet area is substantially enlarged.

12 Claims, 3 Drawing Sheets

IRON CLUB HEAD

BACKGROUND OF THE INVENTION

1. Field of the Invention

The present invention relates to an iron club head which makes it possible to improve the performance to control the ball hit by a player.

2. Description of the Related Art

In general, the iron club is classified into long irons, middle irons, and short irons which are designed such that the flying distance of the hit ball is shortened as the number is increased from those of the long iron to those of the middle iron and the short iron. That is, those having large numbers are designed such that the length of the shaft is short, and the loft angle and the lie angle of the head are large.

Of course, it is required for the golf club that the ball is allowed to successfully fly to a target point as closely as possible, and this feature is easily realized. In such a case, if the ball can be hit within a sweet area of the head, the performance to control the hit ball is improved.

However, it is difficult for many amateur players to hit the ball without fail within the sweet area of the head. Especially, the following adopted design makes hitting the ball more difficult. That is, the smaller the number of the iron club is, the longer the length of the shaft is, and the smaller the loft angle of the head is.

Accordingly, it has been tried to widen the sweet area so that the ball hit point is not deviated from the sweet area even when the ball hit point is dispersed to some extent with the iron club head. For example, when the iron club head is designed so that the moment of inertia of the head is increased, the head tends not to be rotated when the ball is hit. As a result, it is possible to widen the sweet area. In view of the fact as described above, an iron club head has been developed, in which the weight is dominantly distributed to circumferential portions of the head to increase the moment of inertia. Specifically, those called "cavity back" and those having hollow structures are known.

However, the enlargement of the sweet area is not necessarily realized sufficiently in the case of the iron club head as described above. It is demanded to develop an iron club head which makes it possible to further enlarge the sweet area.

SUMMARY OF THE INVENTION

A general object of the present invention is to provide an iron club head which makes it possible to widen the sweet area and improve the performance to control the hit ball.

A principal object of the present invention is to provide an iron club head which makes it possible to easily allow the ball to fly to a position near to a target point.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
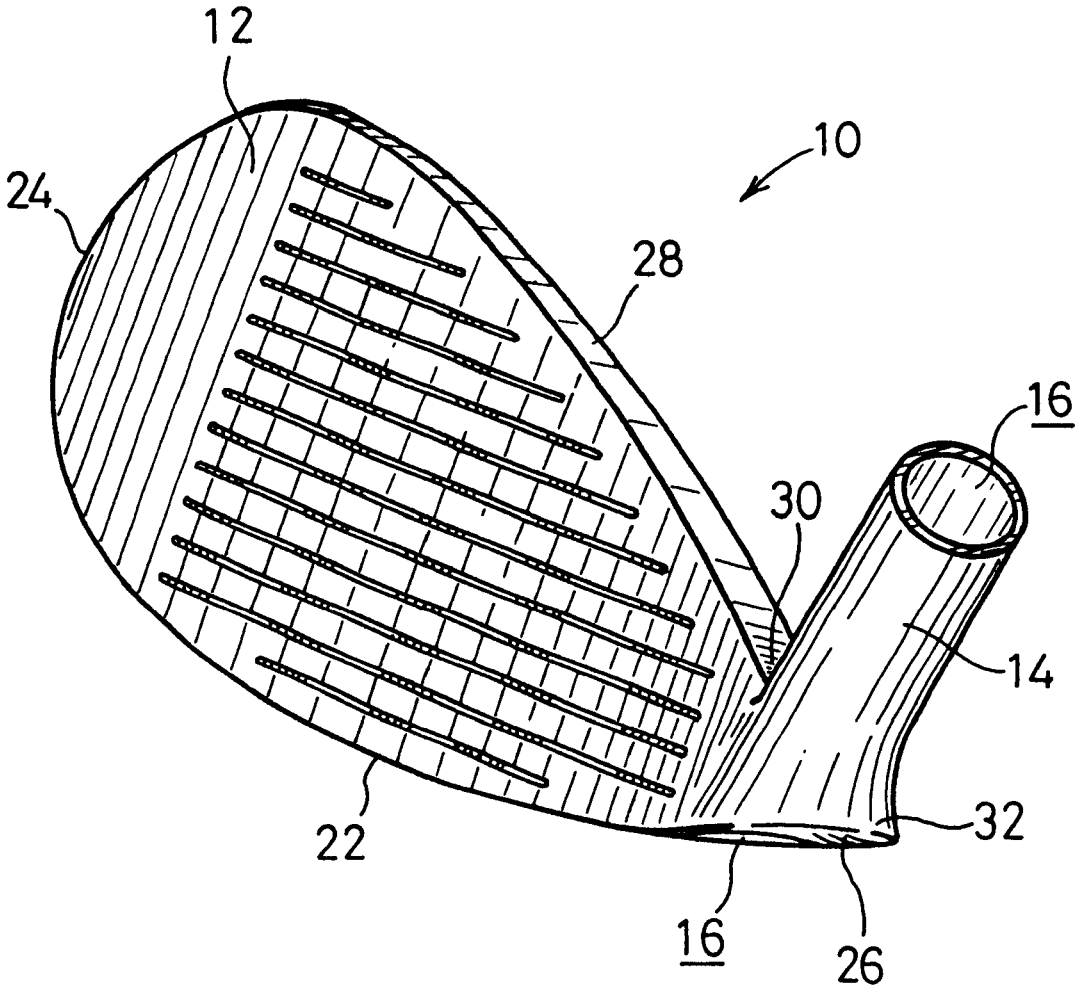
FIG. 1 shows a perspective view illustrating an iron club head according to the present invention.
Figure 2:
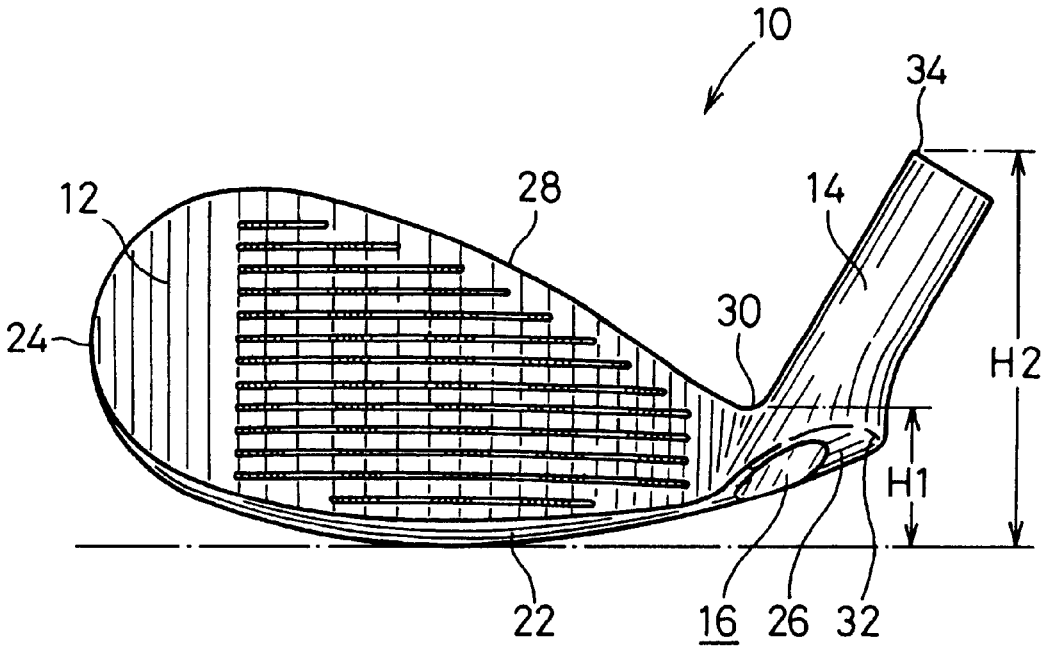
FIG. 2 shows a front view illustrating the iron club head according to the present invention.

FIG. 1 shows a perspective view illustrating an iron club head 10 as an embodiment of the present invention. FIG. 2 shows a front view illustrating the iron club head 10.

Figure 3:
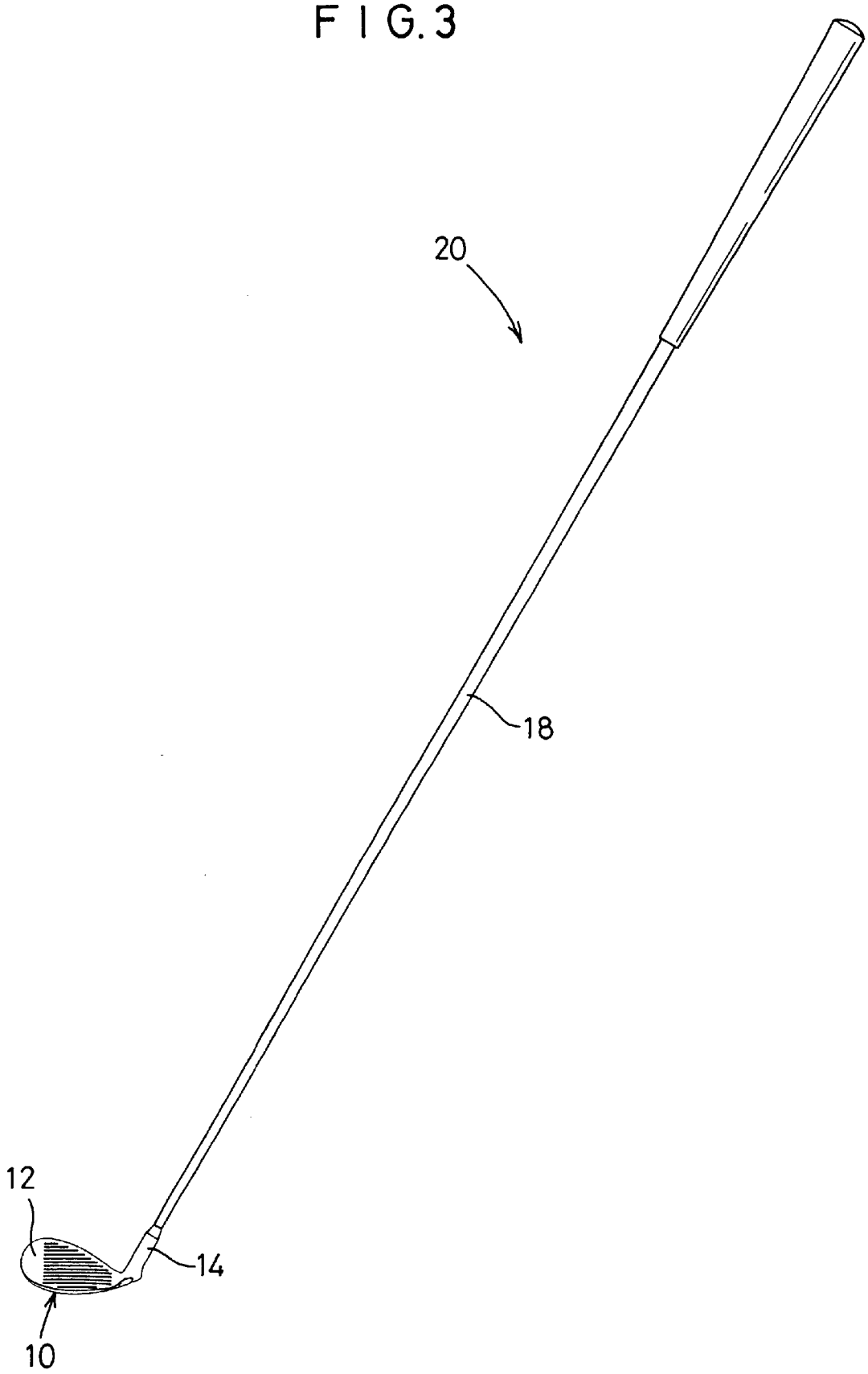
FIG. 3 shows a front view illustrating an iron club provided with the iron club head according to the present invention.

The iron club head 10 has a hosel section 14 which is disposed at the end of a main head body 12. The hosel section 14 has a shaft installation hole 16 which is formed in a penetrating form. As shown in FIG. 3, a shaft 18 is installed to the shaft installation hole 16, and thus an iron club 20 is constructed.

In the embodiment of the present invention, the iron club head 10 is made of alloy steel having a tensile strength of not less than 1800 MPa. However, the material for the head is not specifically limited in the present invention.

The iron club head 10 has a hollow structure which makes it possible to widen the sweet area, in which the loft angle is set to be about 32°, because of the following reason. That is, if the loft angle is set to be not less than 45°, it is inevitable to use a low height of a proximal section of the hosel section continuous to the top, from the lowermost portion of a sole, in the case of the wedge type iron club head.

As shown in FIG. 2, the sole 22 of the main head body 12 is formed to have a curved surface-shaped configuration ranging from the side of a toe 24 to the side of a heel 26. In this arrangement, the sole 22 has a shape of being inclined upwardly at the lower end of the hosel section 14. In the embodiment of the present invention, the radius of curvature of the sole 22 is set to be about 120 mm. However, the radius of curvature of the sole 22 may be set to be smaller than the above within a range of possible shape of the main head body 12.

When the sole 22 is formed to have the curved surface-shaped configuration, the following effect is obtained. That is, the resistance is decreased when the sole 22 contacts with the ground, and it is possible to perform the follow-through in a well-suited manner with the iron club 20 when the ball is shot. When the sole 22 is formed to have the curved surface-shaped configuration, it is also preferable to use a partially different radius of curvature.

A top 28 of the main head body 12 is formed to have a curved surface-shaped configuration ranging from the side of the toe 24 to the side of the hosel section 14. A proximal section 30 of the hosel section 14, which is continuous to the top 28, is formed such that the height H1 from the lowermost portion of the sole 22 is sufficiently low as compared with the conventional iron club head, i.e., about 20 mm. The height H1 of the proximal section 30 can be sufficiently low within a producible range in view of the strength.

The proximal section 30 is set to be sufficiently low, and the sole 22, which is disposed in the vicinity of the lower end of the hosel section 14, is formed to be inclined upwardly. Accordingly, the distance in the vertical direction is remarkably narrow at the end on the side of the hosel section 14 of the main head body 12, and the excessive weight is reduced corresponding thereto as compared with the conventional iron club head.

The weight can be distributed to circumferential portions of the iron club head 10, especially to the side of the toe 24, in response to the amount of reduction of the weight in the vicinity of the proximal section 30 of the main head body 12. Accordingly, it is possible to increase the moment of inertia. As a result, it is possible to enlarge the sweet area.

The distribution of the weight can be realized, for example, by forming a projection at the circumferential portion of the main head body 12, thickening the wall thickness of the circumferential portion, and/or providing a member having a high specific gravity at the circumferential portion. Alternatively, it is also preferable that the outer contour of the main head body 12 is constructed to be large. The reduced weight may be partially distributed to the circumferential portion. It is effective to distribute the weight to a portion which is relatively separated from the center of gravity of the iron club head 10. Therefore, it is desirable that the weight is distributed, for example, to the toe 24, the heel 26, and/or the upper portion of the hosel section 14. Especially, if the weight on the side of the hosel section 14 of the iron club head 10 is excessively decreased, the weight balance of the iron club head 10 is lost in some cases. Therefore, it is preferable that the weight is distributed to at least the heel 26 or the hosel section 14.

In the case of the iron club head 10 according to the embodiment of the present invention, a projection 32 is formed at the end of the heel 26 which is continuous to the hosel section 14. The projection 32 has a shape which is gently expanded in consideration of the design of the iron club head 10. However, there is no special limitation thereto. When the projection 32 as described above is formed, it is possible to add the weight to the side of the heel 26 as compared with the conventional iron club head.

The projection 32 can be produced in the same manner as in the conventional iron club head. Therefore, no difficulty arises during the production.

The height H2 of the uppermost section 34 of the hosel section 14 from the lowermost portion of the sole 22 is set to be high. By doing so, the weight is distributed to the side of the hosel section 14, and it is possible to obtain the iron club head 10 having an excellent weight balance. In this arrangement, a desired weight distribution can be obtained merely by setting the hosel section 14 to be long. In the embodiment of the present invention, the height H2 of the uppermost section 34 is set to be about 55 mm. When the height H2 is set to be not less than about 55 mm, it is 1–5 possible to obtain the effect that the sweet area is successfully widened. However, if the height H2 is excessively high, the weight balance is deteriorated. Therefore, it is preferable that the upper limit is about 60 mm.

It has been hitherto known that the hosel section 14 is shortened while a length necessary to provide the shaft installation hole 16 is allowed to remain. However, in such an arrangement, the weight balance of the iron club head 10 is deteriorated in some cases. When the height H2 of the uppermost section 34 of the hosel section 14 is not less than about 50 mm and not more than about 60 mm, then it is possible to obtain the iron club head 10 having the excellent weight balance, and it is possible to increase the moment of inertia.

As shown in FIGS. 1 and 2, the shaft installation hole 16 of the hosel section 14 penetrates up to the sole 22, and it has a structure called "through-bore". When the through-bore structure is adopted, it is possible to further increase the moment of inertia.

The front edge of the top 28, which is disposed on the side of the face surface, is formed to have a circular arc-shaped configuration with a substantially constant radius of curvature ranging from the proximal section 30 to the highest point of the top 28. In the embodiment of the present invention, the radius of curvature of the circular arc is set to be about 150 mm. It is preferable that the radius of curvature of the circular arc is not less than about 80 mm. When the front edge of the top 28, which is disposed on the side of the face surface, is formed to have the circular arc-shaped configuration, it is possible to allow a player to have the feeling that the ball is grasped by the face surface of the iron club head 10, in other words, the feeling that the ball is correctly hit. Thus, it is possible to expect the reduction of any error concerning the ball hit direction, which would be otherwise caused by any miss shot.

What is claimed is:

1. An iron club head comprising:

a main body; and a hosel section;

wherein a sole of said main body has a curved surface which is continuous to a heel of said main body and which extends along a lower end of said hosel section, said sole being formed to be inclined upwardly toward a side of said heel in a state in which said iron club head is placed on a flat surface in conformity with ordinary address and is viewed from the front thereof, and said sole having a curved surface-shaped configuration ranging from a side of a toe of said main body to said side of said heel;

wherein a proximal section of said hosel section which is continuous to a top of said main body has a height from a lowermost portion of said sole of not more than about 23 mm; and wherein a weight of said main body is distributed to a circumferential portion of said main body.

2. The iron club head according to claim 1, wherein a loft angle of said iron club head is not more than about 43°.

3. The iron club head according to claim 1, wherein a front edge of said top of said main body is disposed on and extends along a side above a face surface of said main body, and is formed to have a circular arc-shaped configuration having a substantially constant radius of curvature.

4. The iron club head according to claim 1, wherein said hosel section comprises a shaft installation hole formed to penetrate up to said sole.

5. An iron club head comprising:

a main body; and a hosel section;

wherein a sole of said main body has a curved surface which is continuous to a heel of said main body and which extends along a lower end of said hosel section, said sole being formed to be inclined upwardly toward a side of said heel in a state in which said iron club head is placed on a flat surface in conformity with ordinary address and is viewed from the front thereof, and said sole having a curved surface-shaped configuration ranging from a side of a toe of said main body to said side of said heel;

wherein a proximal section of said hosel section which is continuous to a top of said main body has a height from a lowermost portion of said sole of not more than about 23 mm; and wherein said heel is formed with a projection.

6. The iron club head according to claim 5, wherein a loft angle of said iron club head is not more than about 43°.

7. The iron club head according to claim 5, wherein a front edge of said top of said main body is disposed on and extends along a side above a face surface of said main body, and is formed to have a circular arc-shaped configuration having a substantially constant radius of curvature.

8. The iron club head according to claim 5, wherein said hosel section comprises a shaft installation hole formed to penetrate up to said sole.

9. An iron club head comprising:

a main body; and a hosel section;

wherein a sole of said main body has a curved surface which is continuous to a heel of said main body and which extends along a lower end of said hosel section, said sole being formed to be inclined upwardly toward a side of said heel in a state in which said iron club head is placed on a flat surface in conformity with ordinary address and is viewed from the front thereof, and said sole having a curved surface-shaped configuration ranging from a side of a toe of said main body to said side of said heel;

wherein a proximal section of said hosel section which is continuous to a top of said main body has a height from a lowermost portion of said sole of not more than about 23 mm; and wherein a height of an uppermost portion of said hosel section from said lowermost portion of said sole is not less than about 50 mm.

10. The iron club head according to claim 9, wherein a loft angle of said iron club head is not more than about 43°.

11. The iron club head according to claim 9, wherein a front edge of said top of said main body is disposed on and extends along a side above a face surface of said main body, and is formed to have a circular arc-shaped configuration having a substantially constant radius of curvature.

12. The iron club head according to claim 9, wherein said hosel section comprises a shaft installation hole formed to penetrate up to said sole.

* * * * *